US009132477B2

(12) United States Patent
Tomioka et al.

(10) Patent No.: US 9,132,477 B2
(45) Date of Patent: Sep. 15, 2015

(54) QUALITY MANAGEMENT DEVICE AND DIE-CAST MOLDING MACHINE

(75) Inventors: Satoshi Tomioka, Zama (JP); Satoru Aida, Zama (JP)

(73) Assignee: Toshiba Kikai Kabushiki Kaisha, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/989,706

(22) PCT Filed: Nov. 15, 2011

(86) PCT No.: PCT/JP2011/076275
§ 371 (c)(1),
(2), (4) Date: May 24, 2013

(87) PCT Pub. No.: WO2012/070426
PCT Pub. Date: May 31, 2012

(65) Prior Publication Data

US 2013/0255902 A1 Oct. 3, 2013

(30) Foreign Application Priority Data

Nov. 24, 2010 (JP) ..... 2010-260907
May 13, 2011 (JP) ..... 2011-108424

(51) Int. Cl.
*B22D 17/32* (2006.01)
*B22D 17/00* (2006.01)

(52) U.S. Cl.
CPC ..... *B22D 17/32* (2013.01); *B22D 17/00* (2013.01)

(58) Field of Classification Search
CPC ..... B22D 27/006; B22D 17/00; B22D 17/14; B22D 17/32
USPC ..... 164/61, 113, 154.8, 253, 312, 457
See application file for complete search history.

(56) References Cited

U.S. PATENT DOCUMENTS 3,382,910 A * 5/1968 Eck et al. ..... 164/55.1
6,125,911 A 10/2000 Wüst et al.

(Continued)

FOREIGN PATENT DOCUMENTS

DE 196 28 870 1/1998
JP 07-068365 3/1995

(Continued)

OTHER PUBLICATIONS

International Search Report issued in PCT/JP2011/0762575 dated Jan. 31, 2012.

(Continued)

*Primary Examiner* — Kevin E Yoon
(74) *Attorney, Agent, or Firm* — DLA Piper LLP (US)

(57) ABSTRACT

A quality management device and a die-cast molding machine capable of suitably inspecting quality in relation to the amount of blowholes of a die-cast product which is cast according to a PF die casting method are provided. A quality management device 3 performs the quality management of the die-cast product formed according to the pore free die casting method of supplying oxygen to a cavity Ca and an injection sleeve 27 communicated with the cavity Ca and, in that state, ejecting a melt in the injection sleeve 27 into the cavity Ca. Further, the quality management device 3 has a vacuum sensor 51 which detects the air pressure in the cavity Ca and a control device 70 which makes good/defective judgment of quality of the die-cast product in relation to the amount of blowholes based on the air pressure detected by the vacuum sensor 51 during injection.

4 Claims, 10 Drawing Sheets

(56) References Cited

U.S. PATENT DOCUMENTS

| | | | | |
|---|---|---|---|---|
| 6,176,294 | B1 | 1/2001 | Kuramasu et al. | |
| 2003/0041993 | A1 * | 3/2003 | Kuramasu et al. | 164/66.1 |
| 2004/0099399 | A1 | 5/2004 | Suzuki et al. | |
| 2006/0137774 | A1 * | 6/2006 | Nagasaka et al. | 148/440 |

FOREIGN PATENT DOCUMENTS

| | | |
|---|---|---|
| JP | 2000-084648 | 3/2000 |
| JP | 2004-154825 | 6/2004 |
| JP | 2006-315022 | 11/2006 |

OTHER PUBLICATIONS

English Language Translation of International Search Report issued in PCT/JP2011/0762575 dated Jan. 31, 2012.
Written Opinion issued in PCT/JP2011/0762575 dated Jan. 31, 2012.
English Language Translation of Written Opinion issued in PCT/JP2011/0762575 dated Jan. 31, 2012.
International Preliminary Report on Patentability issued in PCT/JP2011/0762575 dated Jun. 12, 2013.
English Language Translation of International Preliminary Report on Patentability issued in PCT/JP2011/0762575 dated Jun. 12, 2013.
English Language Abstract for JP 2004-154825 published Jun. 3, 2004.
English Language Translation for JP 2004-154825 published Jun. 3, 2004.
English Language Abstract for JP 2006-315022 published Nov. 24, 2006.
English Language Translation for JP 2006-315022 published Nov. 24, 2006.
English Language Abstract for JP 2000-084648 published Mar. 28, 2000.
English Language Translation for JP 2000-084648 published Mar. 28, 2000.
English Language Abstract for JP 07-068365 published Mar. 14, 1995.
English Language Translation for JP 07-068365 published Mar. 14, 1995.

* cited by examiner

QUALITY MANAGEMENT DEVICE AND DIE-CAST MOLDING MACHINE

CROSS REFERENCE TO RELATED APPLICATIONS

This application is a U.S. National Stage Application of International Application No. PCT/JP2011/076275 filed Nov. 15, 2011, which claims priority from Japanese Patent Application No. 2010-260907 filed Nov. 24, 2010 and Japanese Patent Application No. 2011-108424 filed May 13, 2011.

TECHNICAL FIELD

The present invention relates to a die-cast molding machine capable of inspecting the quality of a die-cast product which is cast by a pore free (PF) die casting method.

BACKGROUND ART

Known in the art is a die casting method called the "PF die casting method". In this die casting method, the atmosphere in a cavity, runner, and injection sleeve is replaced with an active gas (in general, oxygen) before injecting a melt (metal in a molten state). As a result, due to an oxidation reaction between the oxygen and the melt, the cavity becomes decompressed in state, so a die-cast product which has few pores (blowholes) is obtained (see Patent Literature 1).

Further, as a method of measuring the amount of blowholes of a die-cast product, there is known a method using X-ray CT analysis (see Patent Literature 2).

CITATIONS LIST

Patent Literature

Patent Literature 1: Japanese Patent Publication No. 45-10481B2

Patent Literature 2: Japanese Patent Publication No. 2009-183958A

SUMMARY OF INVENTION

Technical Problem

Measurement of the amount of blowholes by X-ray CT analysis has the inconveniences that the equipment is expensive, use online requires installation space for that, the inspection time becomes longer than the cast cycle time, and so on.

Accordingly, preferably there are provided a quality management device and a die-cast molding machine capable of suitably inspecting quality relating to the amount of blowholes of a die-cast product which is cast by the PF die casting method.

Solution to Problem

A quality management device of the present invention is a quality management device of a die-cast product which is formed by a pore free die casting method which supplies an active gas to a cavity and an injection sleeve which is communicated with the cavity and, in that state, ejects a melt which is in the injection sleeve into the cavity, which device has a vacuum sensor which detects the air pressure in the cavity and a control device which makes a good/defective judgment of quality of the die-cast product in relation to the amount of blowholes based on the air pressure which the vacuum sensor detects during the injection.

Preferably, the control device judges there is a defect when a lowest air pressure which the vacuum sensor detects during the injection is higher than a predetermined threshold value.

Preferably, the control device judges there is a defect when a time during which the air pressure which the vacuum sensor detects during the injection is lower than a predetermined reference pressure of not more than the atmospheric pressure is shorter than a predetermined set time.

Preferably, the vacuum sensor is connected to an air vent which exhausts the cavity.

Preferably, the quality management device further has a check valve which allows flow from the air vent to the outside under atmospheric pressure and prohibits flow from the outside to the air vent.

Preferably, the quality management device further has a reporting unit which reports the results of judgment of the control device up to before the start of the next cycle.

Preferably, the system is further provided with a sorting device which sorts the die-cast products in accordance with the results of judgment of the control device.

A die-cast molding machine according to one aspect of the present invention has a clamping device which holds a die configuring a cavity, an injection device which is capable of ejecting a melt which is in an injection sleeve communicated with the cavity into the cavity, an active gas supplying device which is capable of supplying active gas to the injection sleeve, a vacuum sensor which is capable of detecting an air pressure in the cavity, and a control device which makes a good/defective judgment of quality of the die-cast product in relation to the amount of blowholes based on the air pressure which the vacuum sensor detects during the injection.

A die-cast molding machine according to one aspect of the present invention has a clamping device which holds a die configuring a cavity, an injection device which is capable of ejecting a melt which is in an injection sleeve which is communicated with the cavity into the cavity, an active gas supplying device which is capable of supplying active gas to the injection sleeve, a vacuum sensor which is capable of detecting an air pressure in the cavity, and a control device which is capable of controlling the active gas supplying device based on the air pressure which the vacuum sensor detects.

Preferably, the control device increases the active gas which the active gas supplying device supplies in the next cycle when a lowest air pressure which the vacuum sensor detects during the injection is higher than a predetermined threshold value.

Preferably, the control device suspends continuation of a cycle when the air pressure which the vacuum sensor detects during the injection is higher than a predetermined threshold value and predetermined cycle continuation conditions are not satisfied, the cycle continuation conditions include at least one of already increasing the active gas which is supplied before the present cycle and the degree of that increase not exceeding a predetermined level and of increasing the supply amount of the active gas in the present cycle relative the previous cycle and the air pressure which the vacuum sensor detects during the injection in the present cycle becoming lower compared with the previous cycle.

Advantageous Effects of Invention

According to the present invention, a die-cast product which is cast according to the PF die casting method can be suitably inspected.

BRIEF DESCRIPTION OF DRAWINGS

[FIG. 3]

[FIG. 6]

DESCRIPTION OF EMBODIMENTS (First Embodiment)

Figure 1:
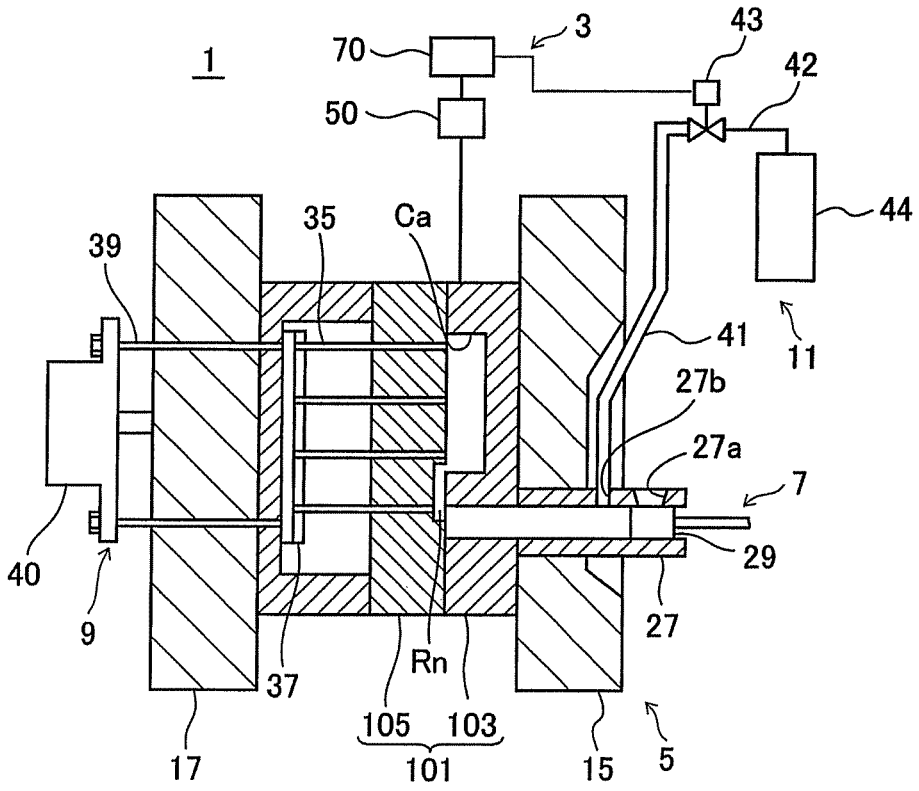
[FIG. 1] A cross-sectional view which shows the configuration of a die-cast molding machine according to a first embodiment of the present invention.
Figure 2:
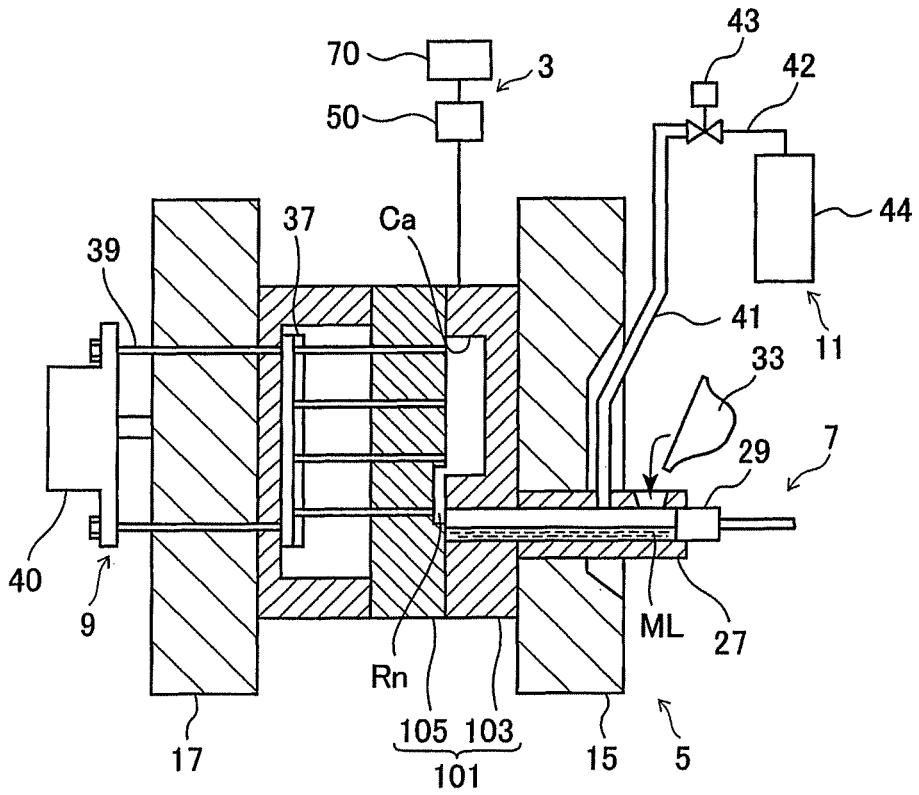
[FIG. 2] A cross-sectional view which shows a melt pouring state of the die-cast molding machine in FIG. 1.

FIG. 1 is a cross-sectional view which shows the configuration of a die-cast molding machine 1 according to a first embodiment of the present invention. FIG. 2 is a cross-sectional view which show a melt pouring state of the die-cast molding machine 1.

The die-cast molding machine 1 has a clamping device 5 which opens/closes and clamps a fixed die 103 and a movable die 105 (below, the two will be sometimes referred to as the "die 101" together), an injection device 7 which injects a melt ML (FIG. 2) into a cavity Ca which is formed in the die 101 which is clamped by the clamping device 5, an ejection device 9 which ejects a die-cast product which is formed by solidification of the melt ML, an oxygen supplying device 11 which supplies active gas (oxygen in the present embodiment) into the cavity Ca, an in-die vacuum degree measuring unit 50 which measures the degree of vacuum in the cavity Ca (in-die vacuum degree), and a control device 70.

Further, the die-cast molding machine 1 has a quality management device 3 for managing the quality of the die-cast product. The in-die vacuum degree measuring unit 50 and control device 70 function as components of the quality management device 3 as well.

The clamping device 5 has a fixed die plate 15 holding the fixed die 103, a movable die plate 17 holding the movable die 105, and a not shown drive unit which can drive the movable die plate 17 in a direction of opening/closing the die. The drive unit is configured by for example a hydraulic cylinder or electric motor or a composite of the same.

[The injection device 7 has a sleeve 27 which is communicated through a runner Rn with the cavity Ca, an injection plunger 29 which can slide in the sleeve 27, and a not shown injection cylinder device which drives the injection plunger 29.

In the sleeve 27, a pouring port 27*a* which is supplied with melt from a ladle 33 (FIG. 2) and an oxygen supplying port 27*b* which is provided on the fixed die plate 15 side other than the pouring port 27*a* and through which oxygen is supplied are opened.

The ejection device 9 has a plurality of ejection pins 35 which abut against the molded article which is formed by the melt ML solidifying, an ejection plate 37 to which the plurality of ejection pins 35 are fixed, ejection rods 39 which are fixed to the ejection plate 37, and an ejection cylinder device 40 which drives the ejection rods 39.

The oxygen supplying device 11 has a pipe 41 which is connected to the oxygen supplying port 27*b*, a valve 43 which is connected to the pipe 41, a pipe 42 which is connected to the valve 43, and an oxygen cylinder 44 (source of supply of active gas) which is connected to the pipe 42.

By opening the valve 43, oxygen of the oxygen cylinder 44 is supplied to the sleeve 27, while by closing the valve 43, the supply of oxygen is suspended. The valve 43 is configured by for example an air drive type valve in order to prevent generation of sparks.

Note that, the amount of oxygen supplied to the sleeve 27 is controlled by for example the opening degree, opening time, duty ratio of opening/closing, and so on of the valve 43. The control of the amount of oxygen may be executed by open loop control without feedback, or may be executed by feedback control based on a not shown flowmeter as well.

The oxygen cylinder 44 may be one having a pressure which is kept constant or may be one which has a pressure which falls along with the supply of oxygen. Note that, even in a case where the pressure of the oxygen cylinder 44 falls, the supply amount of oxygen is kept constant by adjustment of the opening degree etc. of the valve 43.

Figure 3A:
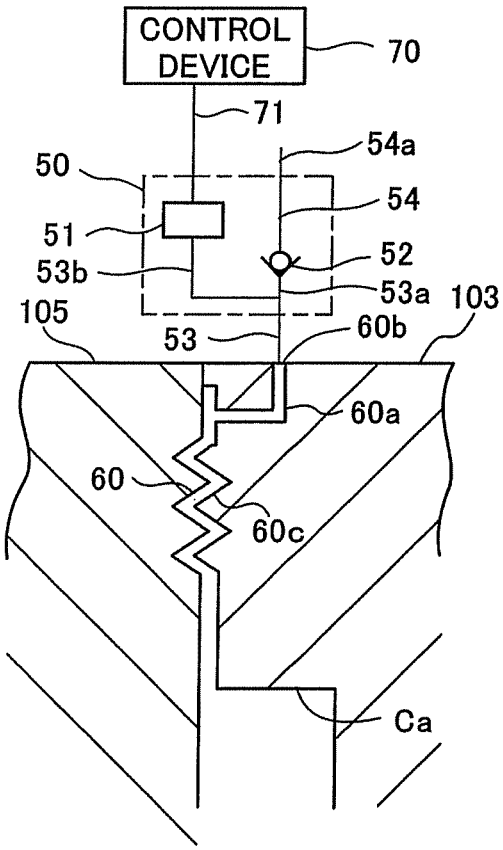
FIG. 3A and FIG. 3B are diagrams which show details of a vacuum degree sensor part of the die-cast molding machine in FIG. 1.
Figure 3B:
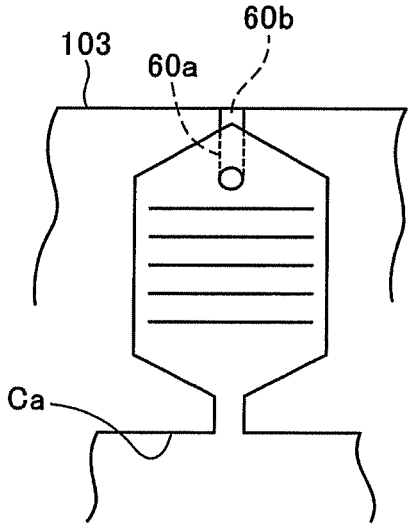

FIG. 3A is a cross-sectional view which shows details of the in-die vacuum degree measuring unit 50 and corresponds to a partially enlarged view of FIG. 1. FIG. 3B is a diagram which views the fixed die 103 from the movable die 105 side in a range which is shown in FIG. 3A.

In the die 101, an air vent 60 for exhausting the interior of the cavity Ca is configured. The air vent 60 is configured by for example a jagged gap (chill vent 60*c*) which is formed between the fixed die 103 and the movable die 105 and by an exhaust passage 60*a* which is connected to the chill vent 60*c* and is formed in the fixed die 103.

The in-die vacuum degree measuring unit 50 has a vacuum sensor 51 and a check valve 52 which are connected to the air vent 60.

More specifically, a pipe 53 is connected to an exhaust port 60*b* of the air vent 60. The pipe 53 is branched to a pipe 53*a* and a pipe 53*b*. The vacuum sensor 51 is connected to the pipe 53*b*, while the check valve 52 is connected to the pipe 53*a*.

The vacuum sensor 51 is for example an electrostatic capacity type or vibration type pressure sensor and outputs an electric signal of a signal level in accordance with the pressure inside the cavity Ca (strictly speaking, the air vent 60, more strictly speaking, the pipe 53*b*) through a wire 71 to the control device 70.

The check valve 52 is arranged between the pipe 53*a* and the pipe 54. A terminal end 54*a* of the pipe 54 is opened to the atmosphere. Further, the check valve 52 allows flow from the cavity Ca (strictly speaking, the air vent 60, further strictly speaking, the pipe 53*a*) to the outside (strictly speaking, the pipe 54), while prohibits the flow in the reverse direction.

Accordingly, when the interior of the cavity Ca is a negative pressure, a state where the interior of the cavity Ca is not opened to the atmosphere is exhibited, so the degree of vacuum is kept. On the other hand, when the interior of the cavity Ca becomes the atmospheric pressure or more, the gas inside the cavity Ca is exhausted through the pipe 54.

Figure 4:
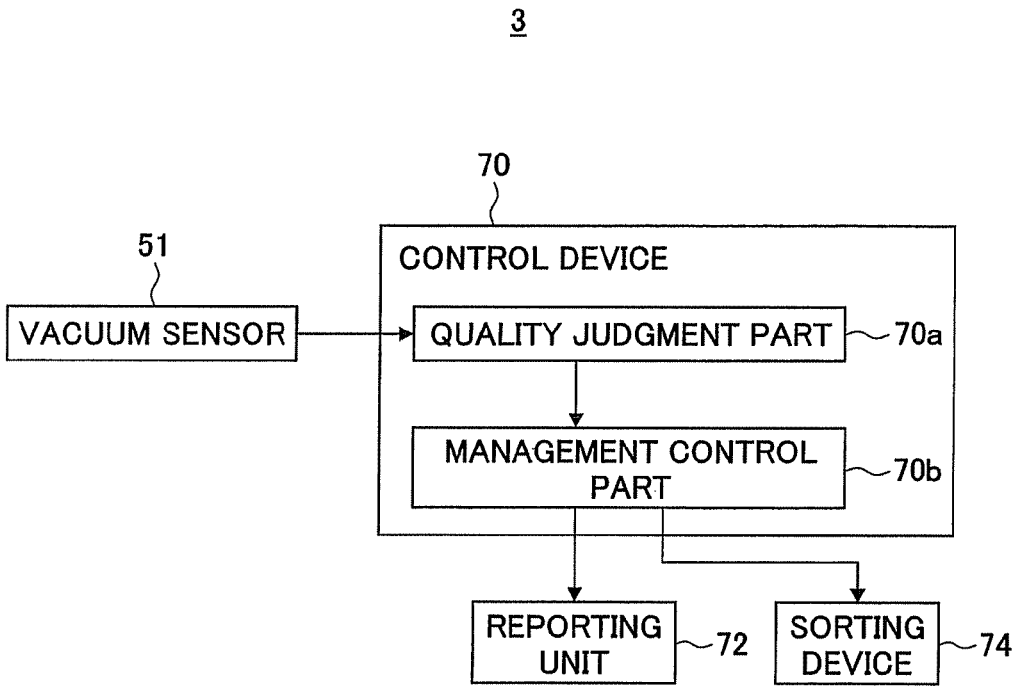
[FIG. 4] A block diagram which shows the configuration of a quality management device of the die-cast molding machine in FIG. 1.

FIG. 4 is a block diagram which shows the configuration of the quality management device 3.

The quality management device 3 has, other than the vacuum sensor 51 and control device 70 explained above, a reporting unit 72 which reports to the user and a sorting device 74 which sorts die-cast products.

The control device 70 is configured by including for example, though not particularly shown, a CPU, ROM, RAM, and external storage device. The CPU runs programs which are stored in the ROM and external storage device. Due to this, a quality judgment part 70*a* and management control part 70*b* are configured.

The quality judgment part 70*a* judges the good/defective of quality of the die-cast product based on the pressure which the vacuum sensor 51 detects. The management control part 70*b* performs processing for making the reporting unit 72 and sorting device 74 perform operations in accordance with the results of the judgment.

The control device 70, though not particularly shown, controls the clamping device 5, injection device 7, ejection device 9, oxygen supplying device 11 etc. That is, the control device 70 performs control concerned with opening/closing of the die, clamping, injection, ejection, and supply of oxygen of the die-cast molding machine as well.

The reporting unit 72 is for example a display device or a sound emitting device. the display device is one which displays images such as a liquid crystal display, or one which reports by lighting up, blinking, or lighting out such as an LED. The sound emitting device is one which outputs a sound such as speaker. For example, when a die-cast product which is judged defective is formed, the reporting unit 72 reports that fact.

The sorting device 74 is configured by for example a product unloading device including a gripping part which grips the die-cast product and an arm which moving the gripping part. Note, the sorting device 74 conveys the die-cast products taken out of the die 101 to separate destinations for good products and defective products. The sorting is carried out according to this.

Figure 5:
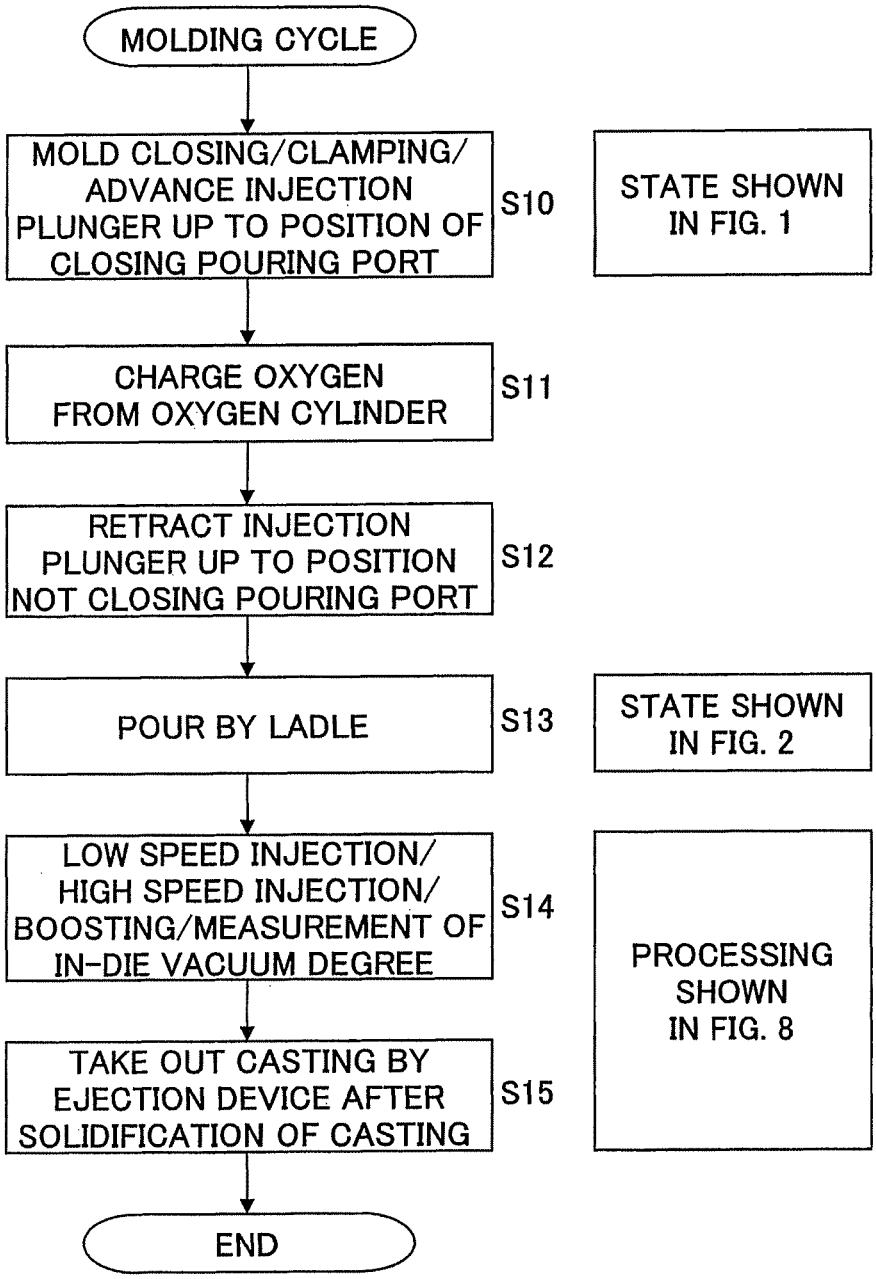
[FIG. 5] A flow chart which shows a molding cycle of the die-cast molding machine in FIG. 1.

FIG. 5 is a flow chart which shows the routine of the molding cycle which the die-cast molding machine 1 performs. The processing is repeatedly performed by a predetermined period.

At step S10, the control device 70 controls the clamping device 5 so as to close and clamp the die. Further, it controls the injection device 7 so as to make the injection plunger 29 advance up to the position of closing the pouring port 27*a* (see FIG. 1).

At step S11, the control device 70 controls the oxygen supplying device 11 so as to open the valve 43 and supply oxygen of the oxygen cylinder 44 to the oxygen supplying port 27*b*. Due to this, the gas inside the sleeve 27, runner Rn, and cavity Ca is replaced with oxygen.

Note that, the amount of the oxygen supplied is a fixed amount determined in advance for each die 101 so that die-cast products having a constant quality in relation to the amount of blowholes are obtained. When oxygen is supplied in the fixed amount, the valve 43 is closed. The timing of closing of the valve 43 may be made a suitable timing before step S14.

At step S12, the injection device 7 is controlled so as to make the injection plunger 29 retract up to the position where it does not close the pouring port 27*a*.

At step S13, the control device 70 controls a not shown melt pouring device so as to pour the melt to the pouring port 27*a* by the ladle 33 (see FIG. 2).

At step S14, the control device 70 controls the injection device 7 so as make the injection plunger 29 advance and eject the melt in the sleeve 27 to the cavity Ca. That is, injection is carried out.

More specifically, for example, the control device 70 first controls the injection device 7 so that a low speed injection operation making the injection plunger 29 advance at a relatively low speed is carried out so as to suppress entrainment of gas by the melt. Then, when the injection plunger 29 reaches a predetermined speed switching position or another predetermined speed switching condition is satisfied, the control device 70 controls the injection device 7 so that a high speed injection operation making the injection plunger 29 advance at a relatively high speed is carried out in order to quickly fill the melt in the cavity Ca.

Further, at step S14, after the high speed injection operation, a boosting step of increasing the pressure of the melt in the cavity Ca is carried out by applying pressure to the melt by the injection plunger 29. For example, the control device 70 switches the control of the injection device 7 from speed control to the pressure control when the injection plunger 29 reaches a predetermined position, the injection pressure reaches a predetermined value, or another predetermined boosting start condition is satisfied.

Further, when the pressure of the melt reaches a predetermined casting pressure, a pressure holding step of holding the pressure of the melt at the casting pressure is carried out by continuing the application of pressure to the melt by the injection plunger 29. While the pressure is held, the melt cools and solidifies.

Further, at step S14, the control device 70 acquire data of the pressure in the cavity Ca during injection based on the detection signal of the vacuum sensor 51. Due to this, as will be explained later with reference to FIG. 8, quality management of the formed die-cast product becomes possible.

At step S15, the control device 70 controls the clamping device 5 so as to open the die and controls the ejection device 9 so as to eject the die-cast product from the movable die 105 by the ejection pins 35.

Figure 6A:
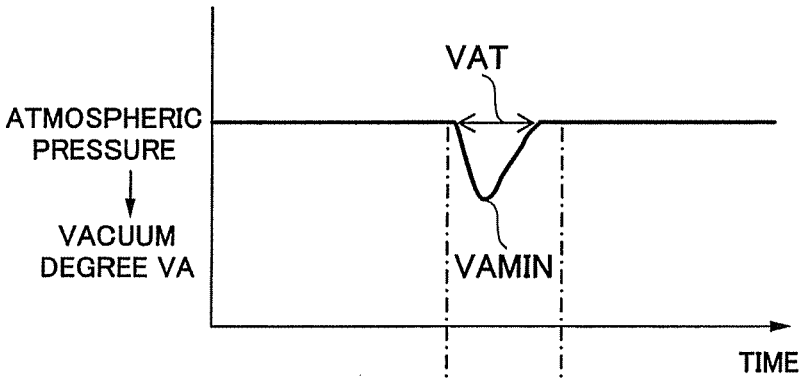
FIGS. 6A-6C are diagrams which show changes along with time in injection speed, injection pressure, and in-die vacuum degree in the die-cast molding machine in FIG. 1.
Figure 6B:
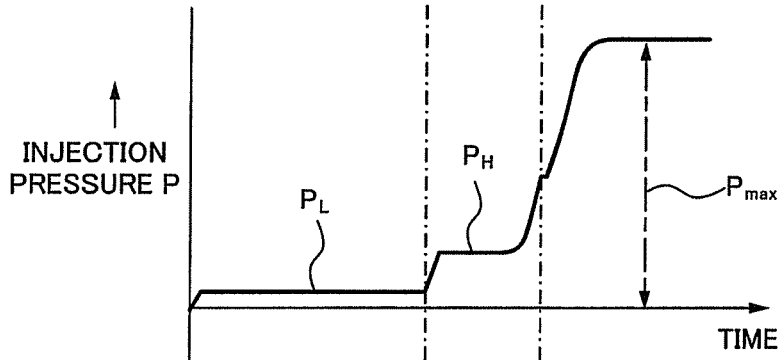
Figure 6C:
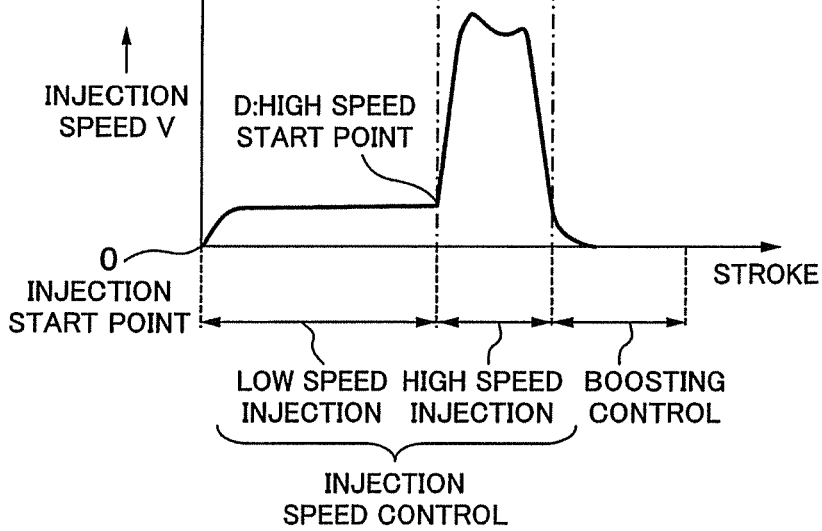

FIGS. 6A-6C are diagrams showing changes along with time in the injection speed (FIG. 6C), injection pressure (FIG. 6B), and in-die vacuum degree (FIG. 6A) at the time of injection and filling of the die-cast molding machine 1 (step S14).

As shown in FIG. 6C, the injection speed V is low in a predetermined period from the start of injection and is switched to high at a high speed start point D. After that, the melt is substantially filled in the cavity Ca so the injection plunger 29 receives a reaction force from the melt or deceleration control is carried out, whereby the injection speed V falls and the injection plunger 29 ends up stopping.

Further, as shown in FIG. 6B, the injection pressure P is a relatively low pressure $P_L$ in the low speed injection operation, while is a pressure $P_H$ which is higher than the pressure $P_L$ in the high speed injection operation. Then, when the melt is substantially filled in the cavity Ca, the injection pressure P rises and reaches the casting pressure $P_{max}$, then it is held.

Further, as shown in FIG. 6A, the in-die vacuum degree VA (air pressure in the die, i.e., detection value of the vacuum sensor 51) is roughly equivalent to the atmospheric pressure during the low speed injection operation and is held at a predetermined value. Further, during the high speed injection operation, due to progress of the reaction between the melt and oxygen, the interior of the cavity Ca is reduced in pressure, so the air pressure falls. After that, when the melt is substantially filled in the cavity Ca, the air pressure in the cavity Ca becomes roughly equivalent to the atmospheric pressure again.

As described above, the air pressure inside the die becomes low during the high speed injection operation. Note that, in the following description, the in-die vacuum degree VA when the air pressure becomes the lowest will be referred to as the "lowest pressure vacuum degree VAMIN".

Figure 7:
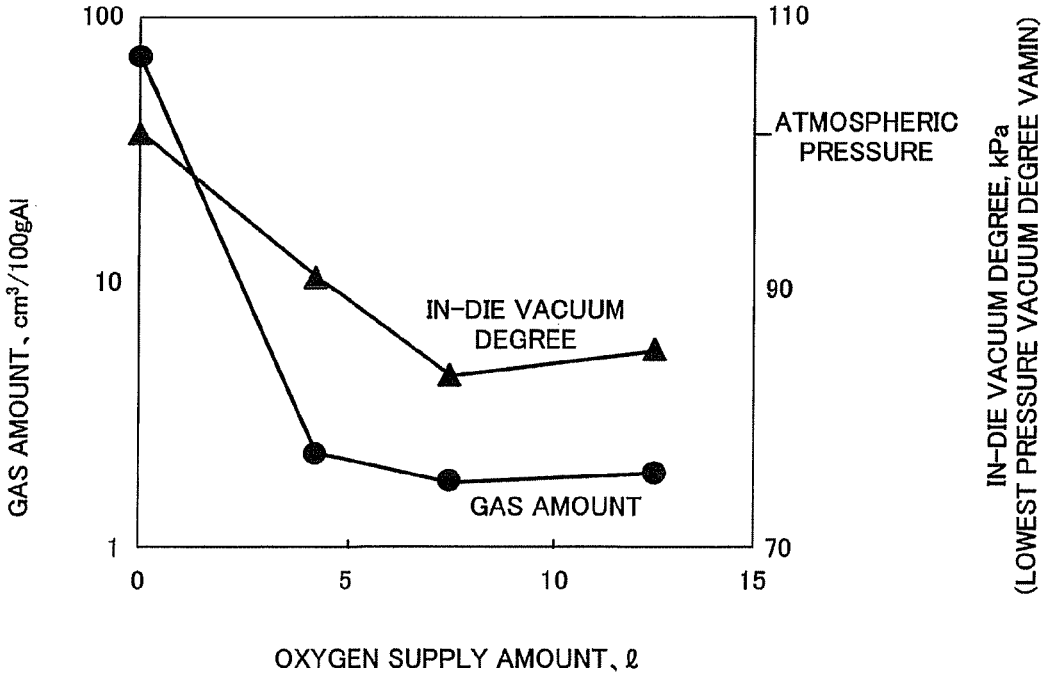
[FIG. 7] A diagram which shows relationships among an oxygen supply amount and in-die vacuum degree and amount of gas of the die-cast product in the die-cast molding machine in FIG. 1.

FIG. 7 shows the relationships among the oxygen supply amount (step S11), the lowest pressure vacuum degree VAMIN, and the amount of gas contained in the die-cast product.

FIG. 7 is based on the actual measurement value in a die. The amount of gas is found by obtaining a sample from among the die-cast products and measuring it by a gas amount measuring device. Note that, the gas amount is a parameter that has a strong correlation with the amount of blowholes. A large gas amount means poor quality in relation to the amount of blowholes.

It is seen from FIG. 7 that when the oxygen supply increases, the gas amount falls and a die-cast product having a higher quality is formed. Note, when the oxygen supply exceeds a predetermined amount, the drop in the gas amount with respect to an increase of the oxygen supply levels off. Accordingly, it is seen that excessive supply of oxygen only causes an increase of cost, so is useless for improving the quality. That is, it is seen that there is an optimum oxygen supply amount.

Further, it is seen from FIG. 7 that the lowest pressure vacuum degree VAMIN (air pressure) falls when the oxygen supply amount increases. On the other hand, as explained above, the larger the oxygen supply amount, the lower the gas amount. Therefore, it is seen from FIG. 7 too that there is correlation between the lowest pressure vacuum degree VAMIN and the gas amount. Accordingly, this means that the good/defective judgment of quality of the die-cast product can be carried out based on the lowest pressure vacuum degree VAMIN.

The drop of the lowest pressure vacuum degree VAMIN (air pressure) with respect to an increase of the oxygen supply amount levels off when the oxygen supply amount exceeds a predetermined amount in the same way as the drop of the gas amount. Note, in FIG. 7, the oxygen supply amount at which the drop in the lowest pressure vacuum degree VAMIN levels off is larger than the oxygen supply amount at which the drop in the gas amount levels off. Accordingly, the oxygen supply amount at which the drop in the lowest pressure vacuum degree VAMIN levels off becomes the oxygen supply amount obtained by adding a predetermined extra margin to the optimum oxidation supply amount.

Note that, in FIG. 7, use was made of the gas amount which is measured by the gas amount measurement device as the parameter showing the quality in relation to the amount of blowholes. However, in place of the gas amount, the amount of blowholes itself obtained by X-ray CT analysis or the like of the die-cast product may be used as the parameter showing the quality in relation to the amount of blowholes and data as shown in FIG. 7 acquired as well.

Based on the findings obtained in FIG. 7 as described above, the quality management device 3 performs quality management of the die-cast product as in the following way.

In the good/defective judgment of quality of the die-cast product in relation to the amount of blowholes, a product is judged as defective when the lowest pressure vacuum degree VAMIN (air pressure) is higher than a predetermined threshold value VALT, while it is judged as a good product when the former is not higher than the latter.

The threshold value VALT is preferably set for each die. This is because the data as shown in FIG. 7 differs according to the die. Note that, the threshold value VALT may be determined based on the data as shown in FIG. 7 which is acquired for a die by experiments or the like. A database is made of such data, data of the most similar die is extracted from the database, and the threshold value VALT may determined based on the data extracted as well. The threshold value VALT may be calculated from a theoretical formula or an equation obtained by regression analysis, using information concerned with the die shape as a parameter as well.

The threshold value VALT may be made for example the value of the in-die vacuum degree VA corresponding to the level of quality (level of amount of blowholes or gas amount) in relation to the amount of blowholes which is demanded in the die-cast product or a value which is smaller than this by a predetermined amount. Note that, the level of the quality which is demanded differs according to the type etc. of the die-cast product.

Further, for example, the threshold value VALT may be made the value of the in-die vacuum degree VA corresponding to the level of the quality at the time when improvement of quality (drop of the amount of blowholes or gas amount) in relation to the amount of blowholes with respect to the increase of the oxygen supply amount levels off. In other words, the threshold value VALT may be determined as the value of the in-die vacuum degree VA corresponding to the optimum oxygen supply amount.

Further, for example, the threshold value VALT may be made the value of the in-die vacuum degree VA at the time when the in-die vacuum degree VA with respect to an increase of the oxygen supply amount levels off. In other words, the threshold value VALT may be made the value of the in-die vacuum degree VA corresponding to the oxygen supply amount obtained by adding a predetermined extra margin to the optimum oxygen supply amount.

Further, the oxygen supply amount at step S11 is set for each die so that the in-die vacuum degree VA becomes the threshold value VALT or less.

For example, the oxygen supply amount is made the oxygen supply amount at the time when the value of the in-die vacuum degree VA becomes the threshold value VALT or an amount which is larger than this by exactly a predetermined extra margin. The extra margin may be suitably set empirically.

Otherwise, the oxygen supply amount is made the oxygen supply amount at the time when the improvement of the quality (drop in the amount of blowholes or gas amount) in relation to the amount of blowholes with respect to an increase of the oxygen supply amount levels off (optimum oxygen supply amount). Note that, at this time, the threshold value VALT may be a value of the in-die vacuum degree VA corresponding to this oxygen supply amount, but need not be so.

Otherwise, the oxygen supply amount is made the oxygen supply amount at the time when the in-die vacuum degree VA with respect to an increase of the oxygen supply amount levels off (the value obtained by adding an extra margin to the optimum oxygen supply amount). At this time, the threshold value VALT may be the value of the in-die vacuum degree VA corresponding to this oxygen supply amount, but need not be so.

In the same way as the threshold value VALT, the oxygen supply amount may be determined based on the data as shown in FIG. 7 which is acquired for a die by experiments or the like. A database is made of such data, data of the most similar die is extracted from the database, and the oxygen supply amount may be determined based on data extracted as well. The oxygen supply amount may be calculated from a theoretical formula or an equation obtained by regression analysis, using information concerned with the die shape and the threshold value VALT as a parameter as well.

Note that, it is also possible to set a common oxygen supply amount with respect to two or more types of dies by setting the oxygen supply to a sufficiently large amount.

Figure 8:
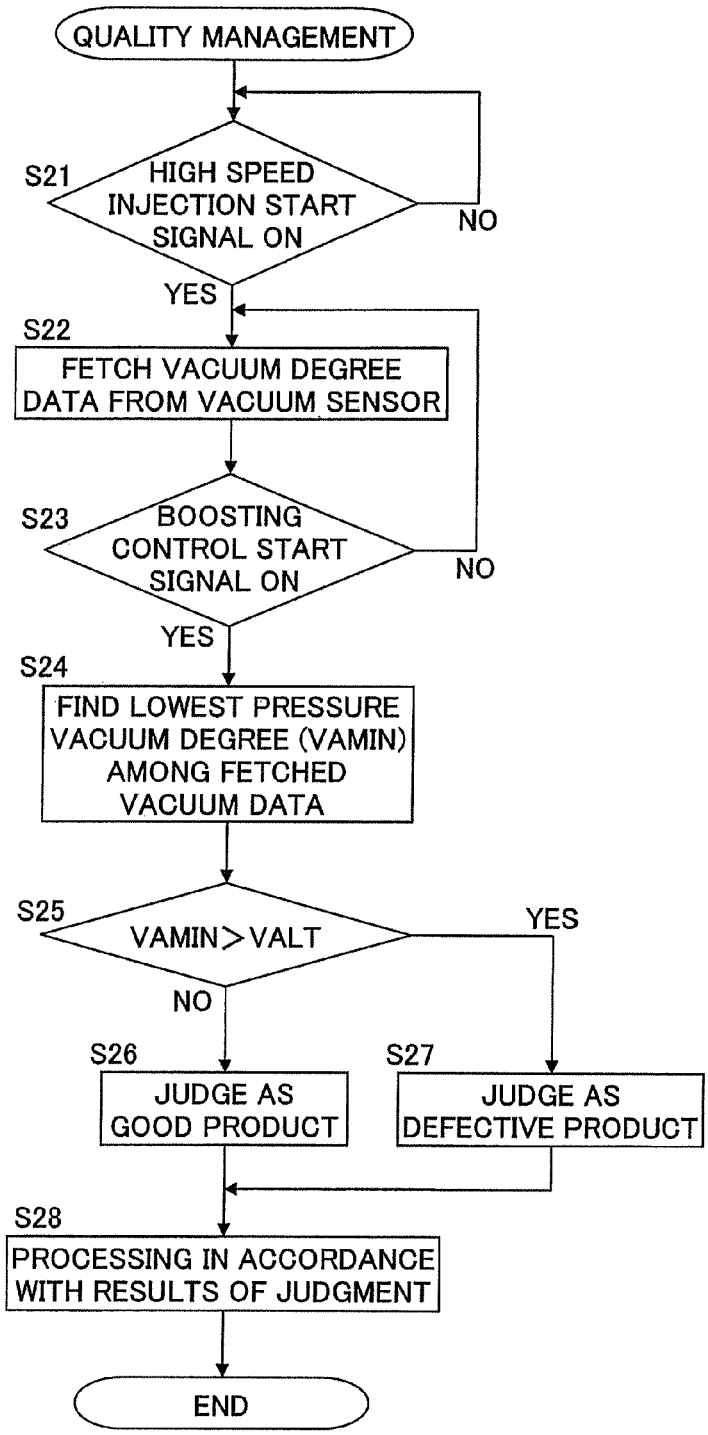
[FIG. 8] A flow chart of the quality management in the die-cast molding machine in FIG. 1.

FIG. 8 is a flow chart showing the routine of the quality management executed by the quality management device 3. The processing is repeatedly executed in synchronization with the molding cycle which is shown in FIG. 5.

At step S21, the control device 70 stands by until the high speed injection operation is started. When the high speed injection operation is started, the routine proceeds to step S22.

At step S22, the control device 70 acquires data of the in-die vacuum degree VA based on the detection signal from the vacuum sensor 51. This data acquisition is continued until it is judged at step S23 that the boosting control has been started. Further, when it is judged that the boosting control has been started, the control device 70 proceeds to step S24.

At step S24, the control device 70 searches for and extracts data showing the lowest pressure, that is, the lowest pressure vacuum degree VAMIN, from the time sequence data of the in-die vacuum degree VA acquired at step S22.

Note that, instead of searching from the time sequence data in step S24, between steps S22 and S23, a step of determining the first acquired in-die vacuum degree VA as a temporary lowest pressure vacuum degree VAMIN, then, when obtaining an in-die vacuum degree VA showing a lower pressure than the temporary lowest pressure vacuum degree VAMIN, making that in-die vacuum degree VA showing a lower pressure as a new temporary lowest pressure vacuum degree VAMIN may be inserted as well.

At step S25, it is judged whether the lowest pressure vacuum degree VAMIN is higher than the threshold value VALT. Then, when it is judged that not higher, the product is judged as a good product (step S26), while when it is judged that higher, the product is judged as a defective product (step S27). Note that, at steps S26 and S27, for example, a flag showing good/defective is set in the control device 70.

At step S28, processing in accordance with the results of the judgment is executed. For example, in the case of judgment as a good product, this is reported at the reporting unit 72. Further, the sorting device 74 carries the die-cast product to the destination of conveyance for good products. On the other hand, in a case where a product is judged as a defective product, that is reported at the reporting unit 72, and the sorting device 74 carries the die-cast product to the destination of conveyance for defective products.

Note that, where the number of times of judgment as defective product and/or a ratio of that exceeds a predetermined reference value or the divergence between the lowest pressure vacuum degree VAMIN and the threshold value VALT is large, processing for stopping the molding cycle may be carried out as well.

According to the above embodiment, the quality management device 3 performs quality management of a die-cast product formed according to the pore free die casting method which supplies oxygen to the cavity Ca and the injection sleeve 27 communicated with the cavity Ca and, in that state, ejects the melt in the injection sleeve 27 to the cavity Ca. Further, the quality management device 3 has the vacuum sensor 51 which detects the air pressure in the cavity Ca and the control device 70 which makes the good/defective judgment of quality of the die-cast product in relation to the amount of blowholes based on the air pressure which by the vacuum sensor 51 detected during injection to.

Accordingly, the good/defective judgment of quality in relation to the amount of blowholes can be executed a short time. For example, it is also possible to make the good/defective judgment of quality of the die-cast product in relation to the amount of blowholes in the molding cycle. As a result, it becomes possible to inform a worker that the amount of blowholes is large by the reporting unit 72 in the molding cycle to make him increase the oxygen supply amount or interrupt the molding cycle and perform other immediate countermeasures. Further, it becomes possible to classify the die-cast products immediately after taking them out of the die 101 into products having a large amount of blowholes and products having a small amount of blowholes. Further, the configuration is simple and small since only a vacuum sensor 51 is provided.

The control device 70 judges there is a defect at the time when the lowest air pressure (the lowest pressure vacuum degree VAMIN) which is detected by the vacuum sensor 51 during injection is higher than the predetermined threshold value VALT. Accordingly, the processing is simple.

The vacuum sensor 51 is connected to the air vent 60 for exhausting the cavity Ca. Accordingly, collision of the injected melt with the vacuum sensor 51 is suppressed, so the vacuum sensor 51 is protected.

The quality management device 3 further has a check valve 52 which allows flow from the air vent 60 to the outside under atmospheric pressure, but prohibits flow from the outside into the air vent 60. Accordingly, at the time when the pressure in the cavity Ca is higher than the atmospheric pressure, addition of that pressure to the vacuum sensor 51 is suppressed and the vacuum sensor 51 is protected. When the pressure in the cavity Ca is lower than the atmospheric pressure, the degree of vacuum in the cavity Ca is measured by the vacuum sensor 51.

The die-cast molding machine 1 has the clamping device 5 which holds the die 101 which configures the cavity Ca, the injection device 7 which is capable of ejecting melt in the injection sleeve 27 communicated with the cavity Ca into the cavity Ca, the oxygen supplying device 11 which is capable of supplying the active gas (oxygen) to the injection sleeve 27, the vacuum sensor 51 which is capable of detecting the air pressure of the cavity Ca, and the control device 70 which makes the good/defective judgment of quality of the die-cast product in relation to the amount of blowholes based on the air pressure detected by the vacuum sensor 51 during injection.

As explained above, it is possible to judge the quality in the molding cycle by the vacuum sensor 51 and the control device 70 (quality management device 3) which makes the good/defective judgment based on the detection value. By provision of such a configuration in the die-cast molding machine 1, a preferred operation of the die-cast molding machine 1 becomes possible.

(Modification)

In the first embodiment, the supply amount of oxygen supplied at step S11 is set in advance based on the data etc. such as shown in FIG. 7. However, as in the modification explained below, the oxygen supply amount may be adjusted based on the inspection of quality of the die-cast product.

Figure 9:
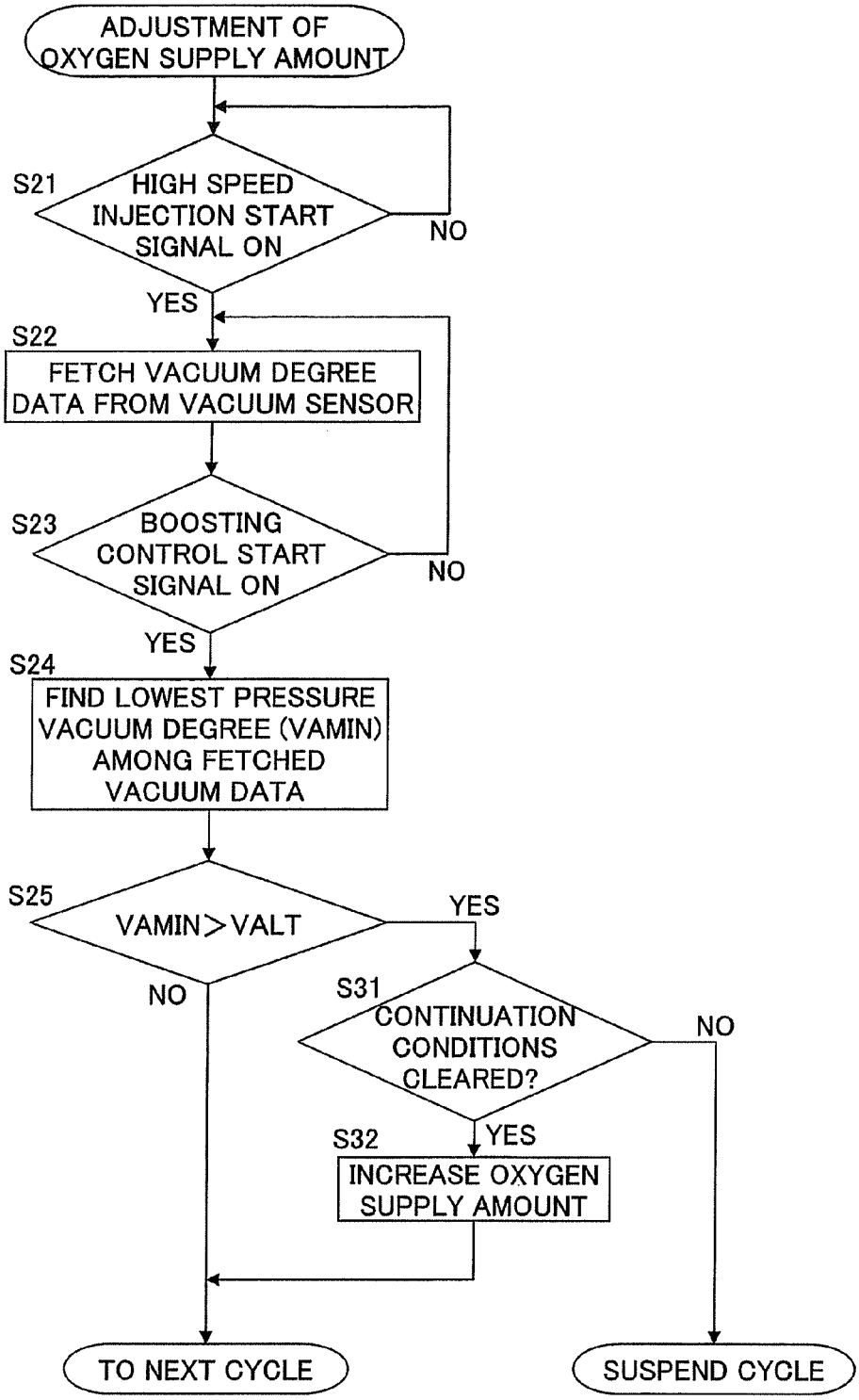
[FIG. 9] A flow chart of adjustment of the amount of oxygen supply in a modification.

FIG. 9 is a flow chart according to the modification which shows the routine of adjustment of the oxygen supply amount which is executed in a die-cast molding machine 1 having the same configuration as that in the first embodiment. The processing is repeatedly executed in synchronization with the molding cycle shown in FIG. 5 in the same way as the processing in FIG. 8. Note that, this processing may be carried out only at a specific time such as trial operation of the die-cast molding machine or at the time of start of operation and may be utilized for determining the oxygen supply amount in advance as well.

Steps S21 to S25 are the same as steps S21 to S25 in FIG. 8.

When it is judged at step S25 that the lowest pressure vacuum degree VAMIN detected by the vacuum sensor 51 is larger than the threshold value VALT (case of judgment as a defective product), the control device 70 increases the set value of the oxygen supply amount (Step S32. Step S31 will be explained later), while when it is judged that not so, the set value of oxygen supply amount is kept as it is. Then, the routine proceeds to the next cycle.

Then, at step S11 shown in FIG. 5 in the next cycle, oxygen is supplied to the sleeve 27 by the value determined in the processing in FIG. 9 as it is or with the increased set value. In the case where the oxygen supply amount is increased, it is expected that the lowest pressure vacuum degree VAMIN will become lower than in the previous cycle. Further, by repeating the molding cycle, the set value of the oxygen supply amount will converge.

Note that, the amount of increase of the oxygen supply amount at step S32 may be a fixed amount which is determined in advance or may be a value in accordance with the difference between the lowest pressure vacuum degree VAMIN and the threshold value VALT.

Here, as explained with reference to FIG. 7, even when the oxygen supply amount is increased exceeding the predetermined amount, the lowest pressure vacuum degree VAMIN is not improved. Accordingly, in a case where a good product is not judged at step S25, although the oxygen supply amount already having exceeded a level where the drop of the lowest pressure vacuum degree VAMIN levels off, it is expected that some abnormality occurred or the setting of the threshold value VALT was not suitable.

Therefore, at step S31, the control device 70 judges whether the condition of already increasing the oxygen supplied before the present cycle and the degree of that increase not exceeding a predetermined level (which may be suitably set) (one example of continuation condition) has been satisfied and/or whether the condition of increasing the oxygen supply amount in the present cycle relative the previous cycle and the lowest pressure vacuum degree VAMIN during injection in the present cycle becoming lower compared with the previous cycle (one example of continuation condition) is satisfied.

Then, the control device 70 executes step S32 only in a case where a continuation condition is satisfied. In a case where they are not satisfied, that effect is reported by the reporting unit 72 or processing for suspending the cycle is executed.

Note that, step 25 substantially corresponds to the good/defective judgment of quality of a die-cast product in relation to the amount of blowholes, therefore the die-cast molding machine 1 which performs the processing which is shown in FIG. 9 suitably inspects the quality of the die-cast product in relation to the amount of blowholes in the same way as the first embodiment. Further, in the modification as well, steps S26 to S28 in FIG. 8 may be executed.

(Second Embodiment)

In the first embodiment and modification, the good/defective judgment etc are executed based on the lowest pressure vacuum degree VAMIN. Contrary to this, in the second embodiment, the good/defective judgment is executed based on the time during which the degree of vacuum is obtained in the die (in-die vacuum time VAT, see FIGS. 6A-6C). Specifically, this is as follows.

The in-die vacuum time VAT is the time during which the air pressure in the die becomes less than the atmospheric pressure while injection. Note that, the in-die vacuum time VAT is mostly included in the time during which the high speed injection operation is performed and becomes short in a case where the oxygen supply amount is not sufficient etc.

Figure 10:
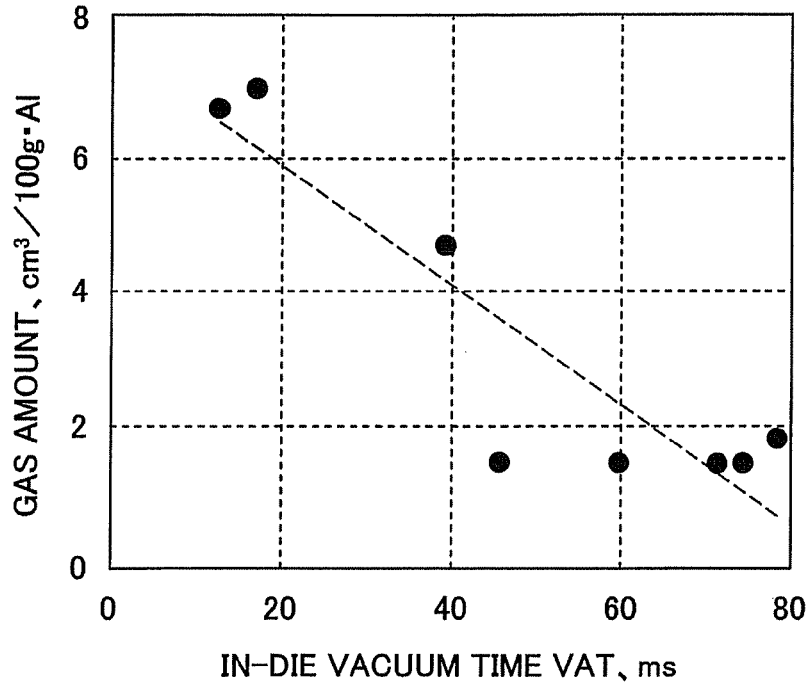
[FIG. 10] A diagram which explains the principle of a second embodiment.

FIG. 10 shows the relationship between the in-die vacuum time VAT and the amount of gas contained in the die-cast product.

It is seen from FIG. 10 that, when the in-die vacuum time VAT increases, the gas amount falls, and a die-cast product having a higher quality is formed. However, when the in-die vacuum time VAT exceeds a predetermined length, the drop of the gas amount with respect to an increase of the in-die vacuum time VAT levels off.

Accordingly, in the same way as the case of use of the lowest pressure vacuum degree VAMIN, by judging there is a defect at the time when the in-die vacuum time VAT is shorter than the set time VAST (corresponding to the threshold value VALT), the good/defective judgment can be suitably carried out.

The set time VAST and the oxygen supply amount may be set in the same way as the first embodiment. That is, preferably the set time VAST and oxygen supply amount are set for each die and may be set based on data, an equation, etc. Further, the set time VAST may be a length corresponding to the level of quality demanded from the die-cast product or longer, or a length whereby the improvement of the quality with respect to an increase of the oxygen supply amount levels off, or a length whereby the in-die vacuum time VAT with respect to an increase of the oxygen supply amount levels off. Further, the oxygen supply amount may be an amount by which the in-die vacuum time VAT becomes the set time VAST or longer, or an amount whereby the improvement of the quality with respect to an increase of the oxygen supply amount levels off, or an amount whereby the in-die vacuum time VAT with respect to an increase of the oxygen supply amount levels off.

Figure 11:
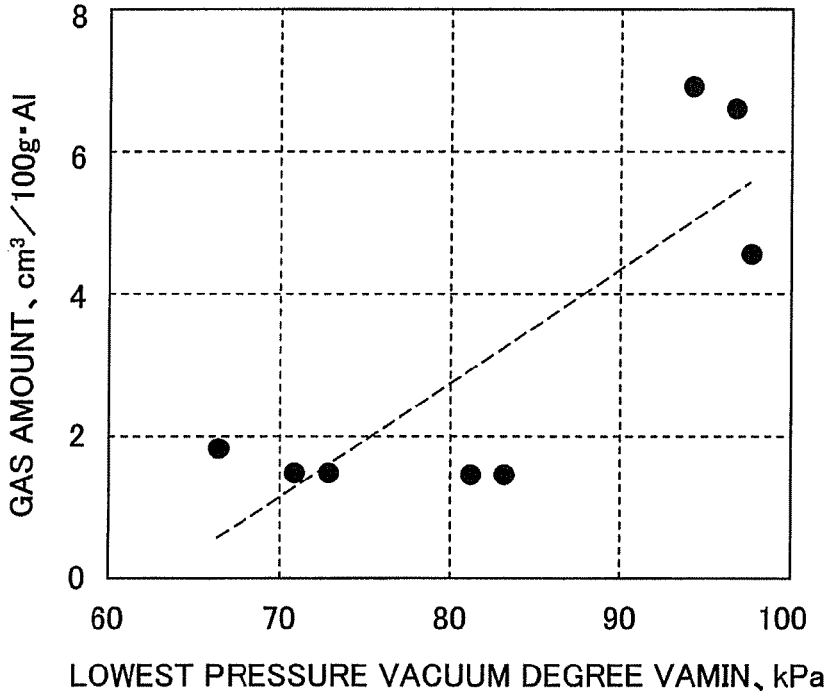
[FIG. 11] Another diagram which explains the principle of the second embodiment.

Note that, FIG. 11 shows the same experimental results as that in FIG. 10 but with the lowest pressure vacuum degree VAMIN plotted on an abscissa in place of the in-die vacuum time VAT. It can be confirmed from this graph that the good/defective judgment can be suitably carried out even when either of the in-die vacuum time VAT or lowest pressure vacuum degree VAMIN is employed. Note that, in the experimental results, the in-die vacuum time VAT has a stronger correlation with the gas amount than the lowest pressure vacuum degree VAMIN.

The configuration and general operation of the die-cast molding machine in the second embodiment are the same as those of the die-cast molding machine 1 in the first embodiment explained with reference to FIG. 1 to FIG. 6C. Further, in the die-cast molding machine 1 in the second embodiment as well, processing which is roughly the same as the processing explained with reference to FIG. 8 is carried out.

However, in the second embodiment, at step S24 in FIG. 8, the in-die vacuum time VAT is extracted in place of the lowest pressure vacuum degree VAMIN being extracted. Further, at step S25 in FIG. 8, in place of the judgment of whether the lowest pressure vacuum degree VAMIN is larger than the threshold value VALT, the judgment of whether the in-die vacuum time VAT is shorter than the set time VAST is carried out.

Further, when it is judged that the in-die vacuum time VAT is shorter than the set time VAST, the product is judged as defective (step S27). Otherwise, it is judged as a good product (step S26).

Further, the die-cast molding machine 1 in the second embodiment may control the oxygen supply amount based on the in-die vacuum time VAT in the same way as the modification shown in FIG. 9. That is, like in FIG. 8 in which the lowest pressure vacuum degree VAMIN at steps S24 and S25 was replaced with the in-die vacuum time VAT, the lowest pressure vacuum degree VAMIN at steps S24 and S25 in FIG. 9 may be replaced with the in-die vacuum time VAT.

The present invention is not limited to the above embodiments and modification and may be executed in various ways.

The die-cast molding machine is not limited to a horizontal clamping horizontal injection type and may be a vertical clamping type or may be a vertical injection type. The method of supply of melt to the injection sleeve is not limited to one by a ladle and may be for example one by an electromagnetic pump.

The injection is not limited to one performing a low speed injection operation and high speed injection operation. For example, the injection may be carried out at a constant speed until the melt is substantially filled in the cavity or may be one making multiple changes in speed.

The detection of the pressure by the vacuum sensor may be carried out not just only during a high speed injection operation or only during injection, but also at other steps. Further, the good/defective judgment based on the pressure detected by the vacuum sensor may be carried out based on the pressure detected in a longer step including the injection step. However, as shown in FIG. 7, the time when the drop of the air pressure in the die occurs is the time when the injection is carried out at a relatively high speed. The good/defective judgment based on the pressure detected by the vacuum sensor substantially becomes the good/defective judgment based on the pressure detected by the vacuum sensor during injection.

The good/defective judgment is not limited to alternative judgment of whether a product is a good product or defective product and may be judgment to which of the levels of quality which are set in ranks a product belongs. The information displayed by the reporting unit may change in accordance with the plurality of ranks of levels of quality or the sorting by the sorting device may be carried out in accordance with the plurality of ranks of levels of quality.

The index of the good/defective judgment is not limited to the lowest pressure vacuum degree VAMIN or the in-die vacuum time VAT. For example, the index may be the mean vacuum degree during the injection or may be the time at which the pressure in the die becomes less than a predetermined reference pressure (however, it is the in-die vacuum time VAT in the case where the reference pressure is the atmospheric pressure). Further, for example, an equation for calculating the amount of blowholes from the detected air pressure may be found in advance by regression analysis, the amount of blowholes may be calculated based on the detected pressure, and that amount of blowholes may be used as the index as well. That is, a value obtained by applying predetermined operation to the air pressure etc. detected by the vacuum sensor may be used as the index as well.

The chill vent is not an essential requirement for the air vent. Further, the vacuum sensor may be provided not in the air vent, but in the cavity. The reporting unit and sorting device are not the essential requirements in the present invention and may be omitted as well.

Reference Signs List

1 . . . die-cast molding machine, 5 . . . quality management device, 23 . . . injection sleeve, 51 . . . vacuum sensor, 70 . . . control device, and Ca . . . cavity.

The invention claimed is:

1. A die-cast molding machine comprising a clamping device which holds a die configuring a cavity, an injection device configured to inject a melt which is in an injection sleeve communicated with the cavity into the cavity, an active gas supplying device configured to supply active gas to the injection sleeve, a vacuum sensor configured to detect an air pressure in the cavity, and a control processor configured to control the active gas supplying device based on the air pressure which the vacuum sensor detects by determining that a lowest air pressure which the vacuum sensor detects during an injection is higher than a predetermined threshold value and increasing the active gas which the active gas supplying device supplies in a next cycle in response to the determining.

2. The die-cast molding machine as set forth in claim 1, wherein the control processor further controls the active gas supplying device by determining that the air pressure which the vacuum sensor detects during an injection is higher than the predetermined threshold value and predetermined cycle continuation conditions are not satisfied and suspending continuation of a cycle in response to the determining, and the cycle continuation conditions include at least one of:

already increasing the active gas which is supplied before the present cycle and the degree of that increase not exceeding a predetermined level, and increasing the supply amount of the active gas in the present cycle relative to the previous cycle and the air pressure which the vacuum sensor detects during the injection in the present cycle becoming lower compared with a previous cycle.

3. A method of die-casting comprising:

supplying, with an active gas supplying device, active gas to an injection sleeve;

pouring a melt into the injection sleeve filled with the active gas;

injecting, with an injection device, the melt in the injection sleeve into a cavity;

detecting, with a vacuum sensor, an air pressure in the cavity during the injecting;

determining, with a control processor, that a lowest air pressure which the vacuum sensor detects during the injecting is higher than a predetermined threshold value; and increasing, with the control processor the active gas which the active gas supplying device supplies in a next cycle in response to the determining.

4. The method as set forth in claim 3, further comprising:

determining, with the control processor, that the air pressure which the vacuum sensor detects during the injecting is higher than the predetermined threshold value and predetermined cycle continuation conditions are not satisfied; and suspending, with the control processor, continuation of a cycle in response to the determining;

wherein the cycle continuation conditions include at least one of:

already increasing the active gas which is supplied before the present cycle and the degree of that increase not exceeding a predetermined level, and increasing the supply amount of the active gas in the present cycle relative to the previous cycle and the air pressure which the vacuum sensor detects during the injecting in the present cycle becoming lower compared with a previous cycle.

* * * * *